US006138682A

United States Patent [19]

Lai

[11] Patent Number: 6,138,682

[45] Date of Patent: Oct. 31, 2000

[54] PORTABLE PUT OUT DEVICE FOR CIGARETTES

[76] Inventor: Chin I. Lai, No. 666, Kung Yuan Road, Tainan City, Taiwan

[21] Appl. No.: 09/267,939

[22] Filed: Mar. 11, 1999

[51] Int. Cl.[7] ..... A24D 1/12

[52] U.S. Cl. ..... 131/231; 131/238; 131/240.1; 131/241; 131/242.6; 131/256; 202/246

[58] Field of Search ..... 131/231, 242, 131/240.1, 241, 242.6, 238, 256; 202/246; D27/102, 103, 104, 105

[56] References Cited

U.S. PATENT DOCUMENTS 3,561,452 2/1971 Artelli ..... 131/235
5,205,299 4/1993 Chen ..... 131/231
5,617,880 4/1997 Landuydt ..... 131/237
5,924,425 7/1999 Luedecke ..... 131/231

*Primary Examiner*—Stanley S. Silverman
*Assistant Examiner*—Mark Halpern
*Attorney, Agent, or Firm*—Charles E. Baxley, Esq.

[57] ABSTRACT

A portable put out device for cigarettes includes a heat-durable casing including an ash compartment and a butt compartment. A heat-durable meshy plate is mounted in the ash compartment. An upper lid is pivotally mounted to an open upper end of the casing. A heat-durable bottom plate is removably mounted to and thus encloses an open lower end of the casing. A carriage member is secured to the casing to allow the put out device to be attached to an article worn by a user.

8 Claims, 7 Drawing Sheets

PORTABLE PUT OUT DEVICE FOR CIGARETTES

BACKGROUND OF THE INVENTION

1. Field of the Invention

The present invention relates to a put out device that is portable and is thus convenient to the user for putting out cigarettes and receiving ashes and cigarette butts.

2. Description of the Related Art

Smoking is prohibited in public areas in some countries to improve air quality and prevent harm to people that do not smoke. Cigarette ashes and butts cause a problem in public areas where ash tray or ash container is not provided. The cigarette butts may cause fires if not put out. The present invention is intended to provide a portable put out device for cigarette that mitigates and/or obviates the above problems.

SUMMARY OF THE INVENTION

A portable put out device for cigarettes in accordance with the present invention includes:

- a heat-durable casing including an ash compartment and a butt compartment, the casing including an open upper end and an open lower end,
- a heat-durable meshy plate mounted in the ash compartment,
- an upper lid pivotally mounted to the open upper end of the casing,
- a heat-durable bottom plate removably mounted to and thus enclosing the open lower end of the casing, and
- a carriage member secured to the casing and allowing the put out device to be attached to an article worn by a user.

In a preferred embodiment of the invention, the casing includes a horizontal receptacle defined therein and a vertical hole defined in an upper side thereof and communicated with the horizontal receptacle. The upper lid further includes a latch with a recess formed on an underside thereof, the latch being removably received in the vertical hole upon pivotal movement of the upper lid relative to the casing. At least one torsional spring is provided and has a first end attached to the underside of the upper lid and a second end attached to the casing for biasing the upper lid to an open position. A ball is mounted in the horizontal receptacle and a spring is mounted in the horizontal receptacle for biasing the ball to engage with the recess of the latch to retain the upper lid in a closed position. The upper lid further includes a recessed section for manual operation to pivot the upper lid relative to the casing. The latch may thus be removed out of the vertical hole to disengage the ball from the recess of the latch to allow opening of the upper lid under the action of the torsional spring. The recess of the latch may have a diameter smaller than that of the ball.

In an embodiment of the invention, the casing includes two half casings. Each half casing includes a separation wall to thereby define the ash compartment and the butt compartment when the half casings are assembled together. The first half casing includes a plurality of pegs provided along a periphery thereof, and the second half casing includes a plurality of holed stubs provided along a periphery thereof for releasably engaging with the pegs. Each of the first half casing and the second half casing includes a ledge extended inwardly from a lower end thereof, and the bottom plate includes two lateral wings that slidably abut against the ledges, respectively. Each ledge has at least one depression on an underside thereof, and the bottom plate includes a corresponding number of knurls for releasably engaging with said at least one depression.

In an embodiment of the invention, the casing includes two vertically spaced ribs formed on an inner periphery that defines the ash compartment to thereby define a receiving groove therebetween for securely receiving the meshy plate.

Thus, the user may carry the put out device to handle cigarette ashes and butts without any inconvenience.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
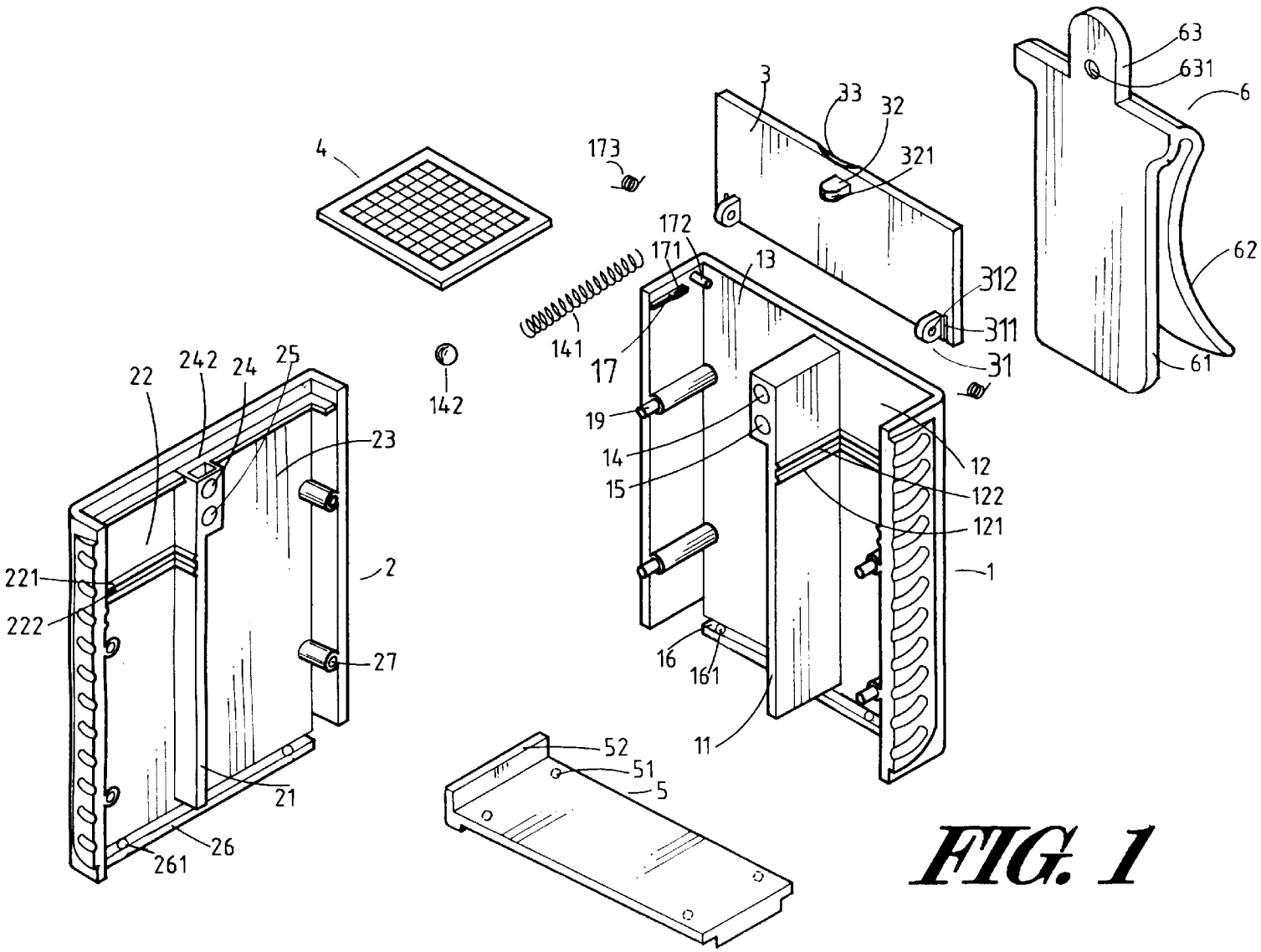
FIG. 1 is an exploded perspective view of a portable put out device for cigarettes in accordance with the present invention.
Figure 2:
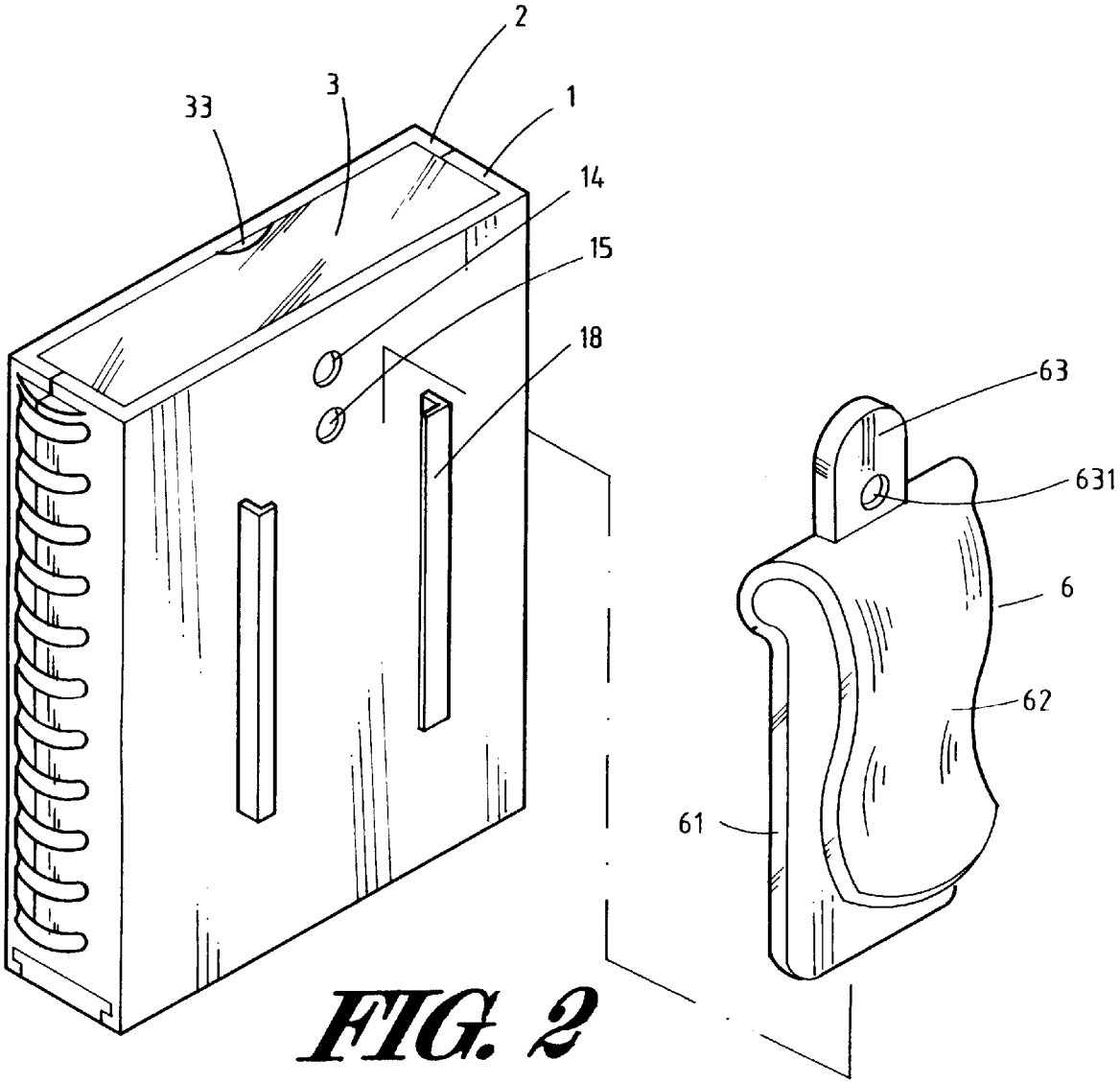
FIG. 2 is a perspective view, partly exploded, of the portable put out device for cigarettes in accordance with the present invention.
Figure 3:
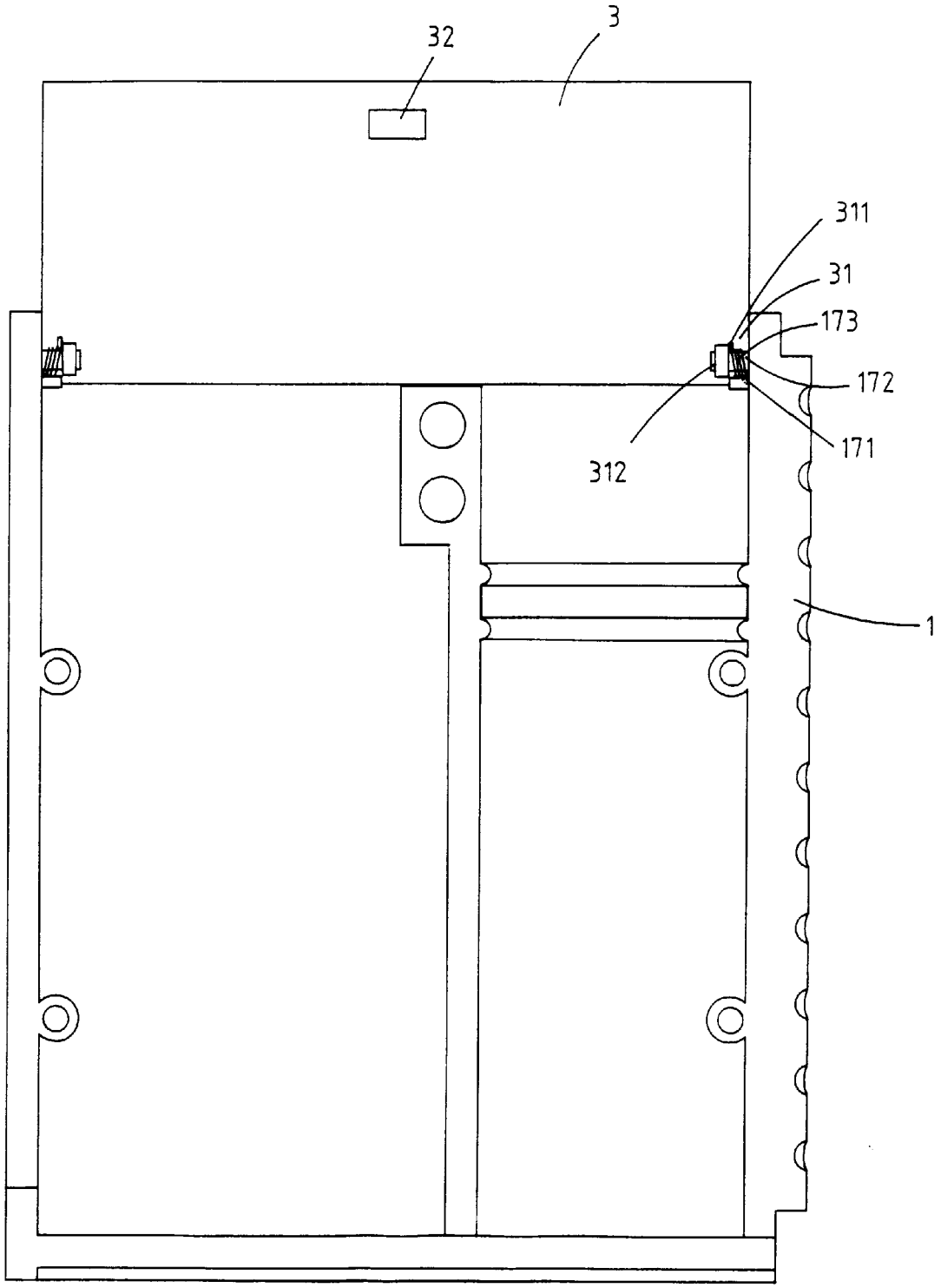
FIG. 3 is a front view of a half casing of the portable put out device for cigarettes in accordance with the present invention.

Referring to FIGS. 1 and 2, a portable put out device for cigarettes in accordance with the present invention generally includes a first half casing 1, a second half casing 2, a bottom plate 5, an upper lid 3, a meshy plate 4, and a carriage member 6. Each half casing 1, 2 includes a separation wall 11, 21 to define an ash compartment 12, 22 and a butt compartment 13, 23 when the half casings 1 and 2 are assembled together. Each ash compartment 12, 22 includes two vertically spaced ribs 121 and 122, 221 and 222 to define a receiving groove (not labeled) therebetween for receiving the meshy plate 4 when the half casings 1 and 2 are assembled together. The bottom plate 5 is removably attached to and thus encloses an open underside of the half casings 1 and 2. In this embodiment, each half casing 1, 2 includes a ledge 16, 26 extended inwardly from a lower end thereof, and the bottom plate 5 includes two lateral wings 53 that slidably abut against the ledges 16 and 26, respectively, best shown in FIG. 4. In addition, each ledge 16, 26 includes a number of depressions 161, 261 in an underside thereof, and the bottom plate 51 includes a corresponding number of knurls 51 formed on an upper side thereof for releasably engaging with the depressions 161, 261. The depressions 161, 261 and the knurls 51 increase the positioning effect between the bottom plate 5 and the assembled half casings 1 and 2 yet allow easy removal of the bottom plate 5 from the half casings 1 and 2 if a larger force is applied to pull the bottom plate 5 away from the half casings 1 and 2. The bottom plate 5 may further include an upright wall 52 on an end thereof for finger's grasp.

Engagement between the half casings 1 and 2 can be achieved by many ways. In this embodiment, the half casing 1 includes a number of pegs 19 provided along a periphery thereof while the half casing 2 includes a number of holed stubs 27 provided along a periphery thereof for releasably engaging with the pegs 19.

The separation walls 11 and 21 further include aligned horizontal receptacles 14 and 24 and aligned horizontal assembly holes 15 and 25. The separation wall 21 further includes a vertical hole 242 that communicates with the transverse receptacle 24. A ball 142 is mounted in the transverse receptacles 14 and 24, and a spring 141 is also mounted in the receptacle 14 for biasing the ball 142 into the vertical holes 24.

The first half casing 1 further includes aligned pins 172 formed on two opposite inner side walls thereof. Each of the opposite inner side walls of the half casing 1 further includes a mounting piece 17 with a retaining slot 171, which will be described later. The upper lid 3 includes spaced lugs 31 formed on an underside thereof. The lugs 31 include aligned holes 312 through which the pins 172 are extended, respectively. Adjacent to each lug 31 a retaining groove 311 is defined in the underside of the upper lid 3. Two torsional springs 173 are provided and each includes a first end retained in the retaining groove 311 and a second end retained in the retaining slot 171 for biasing the upper lid 3 to an open position. Also formed on the underside of the upper lid 3 is a latch 32 with a recess 321 for releasably engaging with the ball 142 to retain the upper lid 3 in a closed position, best shown in FIG. 4.

Figure 8:
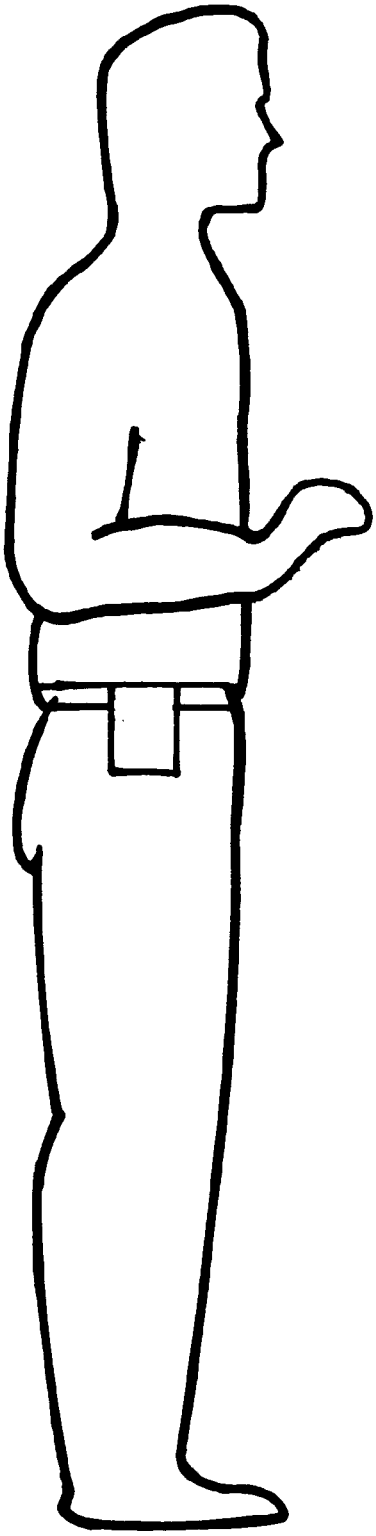
FIG. 8 is a schematic view illustrating attachment of the portable put out device for cigarettes to a user.

The carriage member 6 includes an attachment plate 61 and an arcuate retaining plate 62 that has an upper end integral with the attachment plate 61 and a lower end extended away from the attachment plate 61, thereby forming a clearance (not labeled) between the arcuate retaining plate 62 and the attachment plate 61. The carriage member 6 is attached to the assembled half casings 1 and 2 by means of extending an engaging pin 64 (FIG. 4) through a hole 631 in a tab 63 protruded from an upper end of the attachment plate 61 and through aligned transverse assembly holes 15 and 25 of the half casings 1 and 2. Thus, the put out device in accordance with the present invention can be attached to, e.g., the belt of a user, as shown in FIG. 8. It is appreciated that the tab 63 retains the spring 141 in the receptacle 14 of the first half casing 1, as shown in FIG. 4.

Figure 4A:
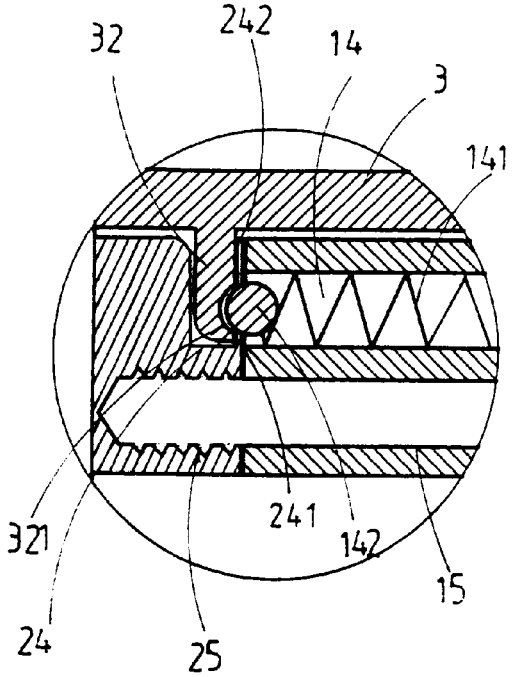
FIG. 4A is an enlarged view of a circle in FIG. 4.
Figure 4:
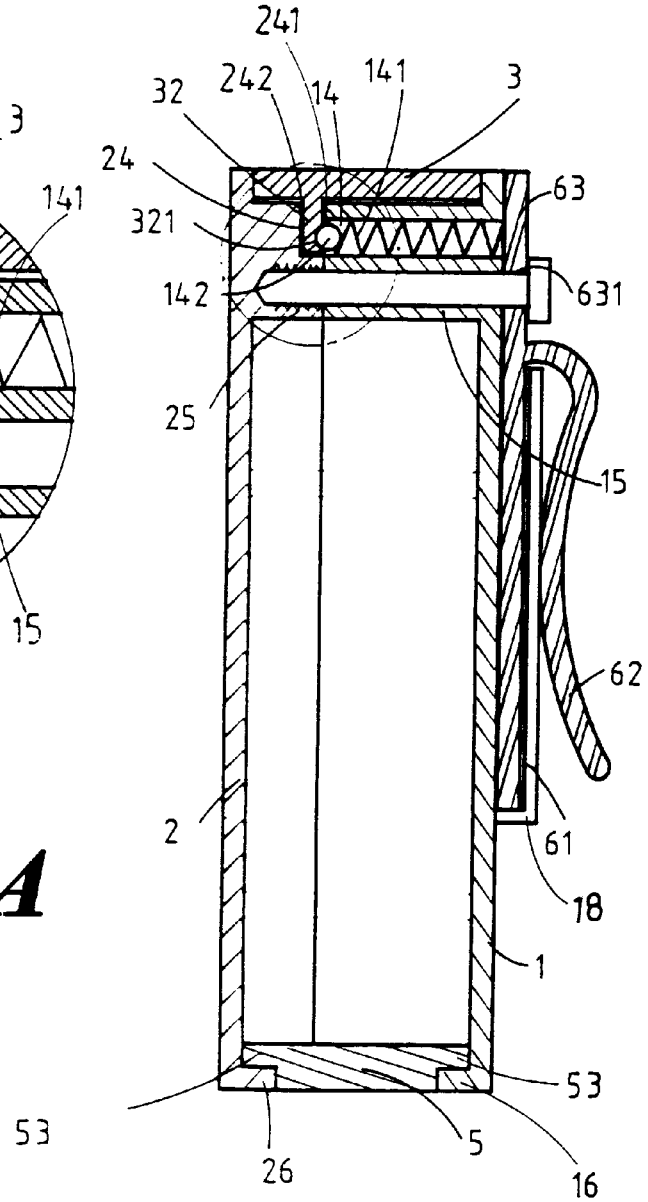
FIG. 4 is a cross-sectional view of the portable put out device for cigarettes in accordance with the present invention.
Figure 5:
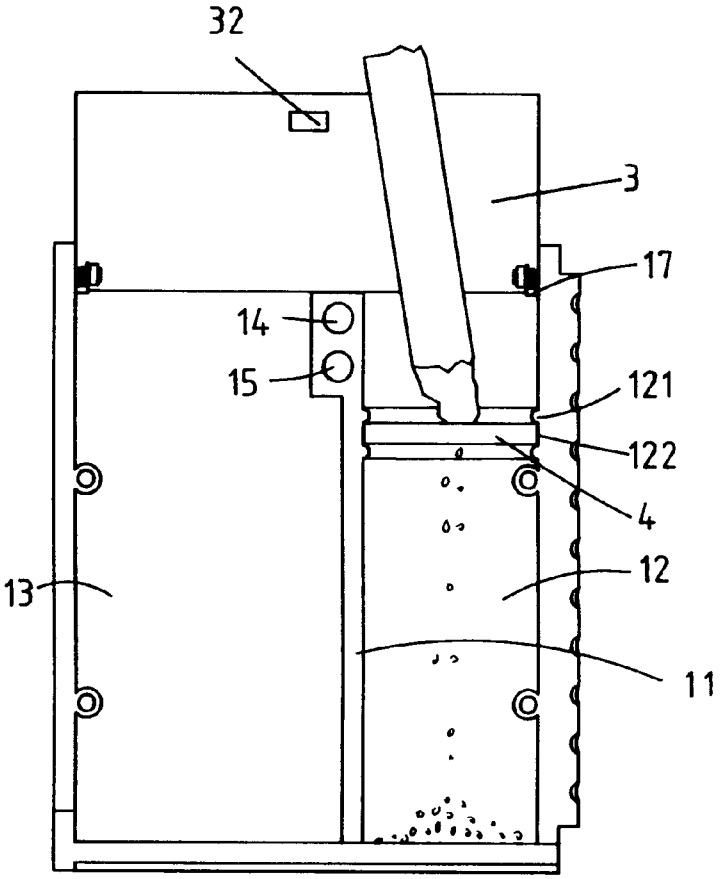
FIG. 5 is a schematic view illustrating putting out a cigarette by the portable put out device for cigarettes in accordance with the present invention, wherein a half casing is removed for clarity.
Figure 6:
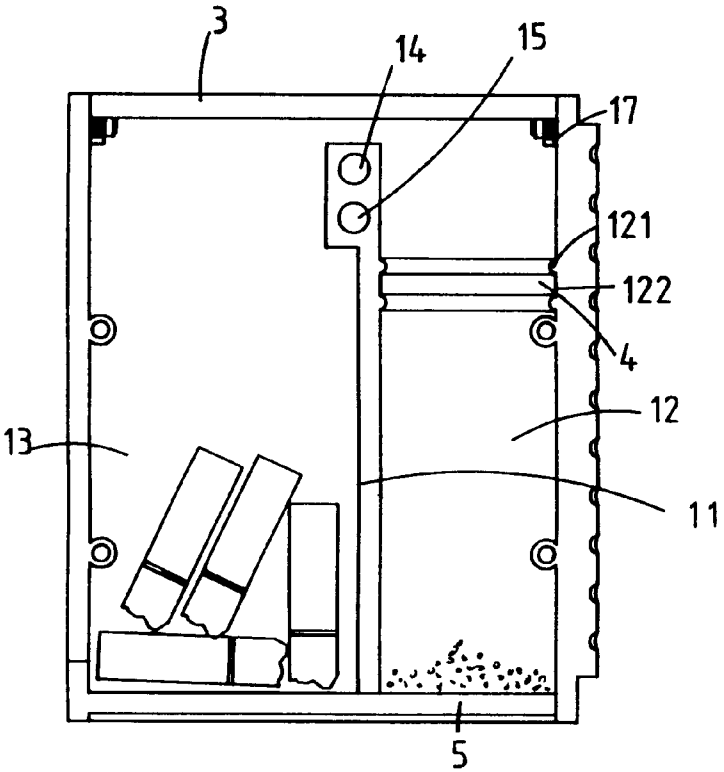
FIG. 6 is a schematic view illustrating receiving of cigarette butts by the portable put out device for cigarettes in accordance with the present invention, wherein a half casing is removed for clarity.
Figure 7:
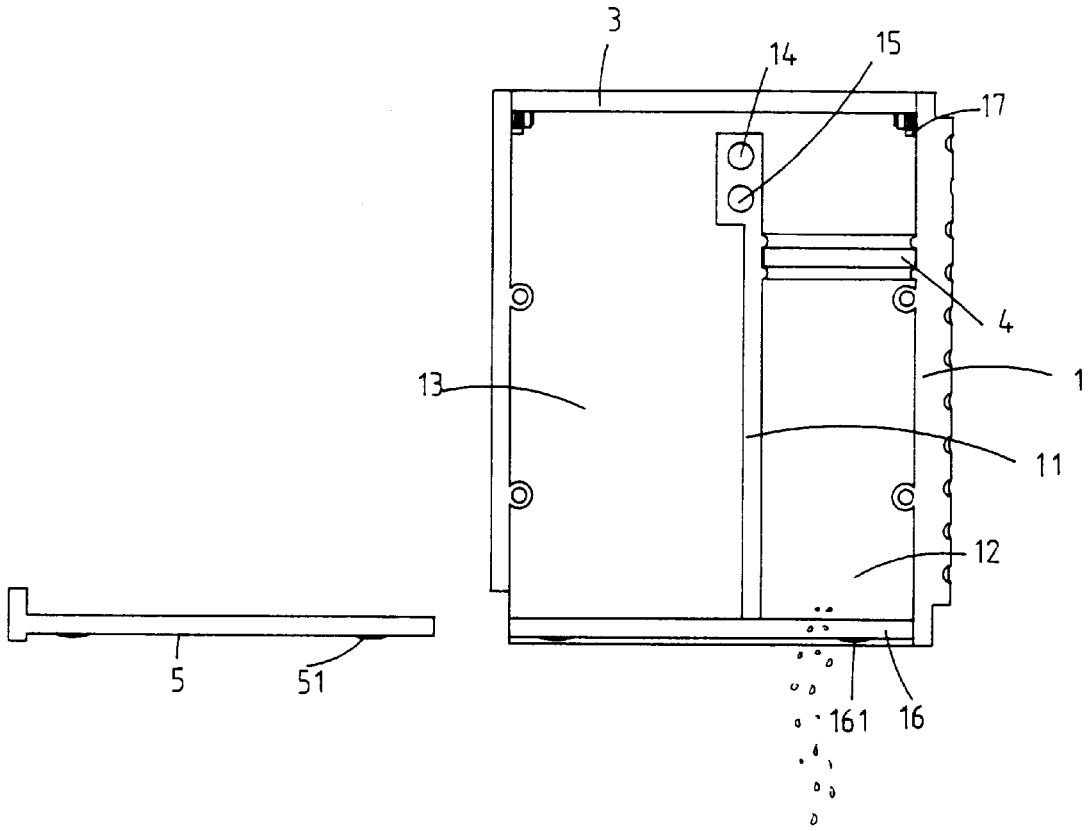
FIG. 7 is a schematic view illustrating cleaning of ashes and cigarette butts.

Still referring to FIG. 4, the upper lid 3 is normally in a closed position, as the ball 142 engages with the recess 321 of the latch 32 that is received in the vertical hole 242, best shown in FIG. 4A. Preferably, the recess 321 of the latch 32 has a diameter smaller than that of the ball 142. When putting out a cigarette, the user may open the upper lid 3 by lifting a recessed portion 33 (FIG. 1) to cause the latch 32 to leave the vertical hole 242 and thus disengage from the ball 142. The upper lid 3 springs to its open position under the action of the torsional springs 173, as shown in FIG. 5. Thus, the cigarette ashes may be received in the ash compartments 12, 22 via the meshy plate 4. In addition, the user may put out the cigarette by the meshy plate 4. Then, the cigarette butt is thrown into the butt compartment 13, 23, best shown in FIG. 6. Cleaning of the put out device can be easily accomplished after the bottom plate 5 is removed, best shown in FIG. 7.

According to the above description, it is appreciated that the put out device for cigarettes in accordance with the present invention is portable and convenient to users for handling cigarette ashes and butts.

It is appreciated that the half casings 1 and 2, the bottom plate 5, and the meshy plate 4 are made of metal or heat-durable material.

Although the invention has been explained in relation to its preferred embodiment, it is to be understood that many other possible modifications and variations can be made without departing from the spirit and scope of the invention as hereinafter claimed.

What is claimed is:

1. A put out device for cigarettes, comprising:

a heat-durable casing including an ash compartment and a separate butt compartment, the casing including an open upper end and an open lower end, a heat-durable meshy plate mounted in the ash compartment, an upper lid pivotally mounted to the open upper end of the casing, a heat-durable bottom plate removably mounted to and thus enclosing the open lower end of the casing, and a carriage member secured to the casing and allowing the put out device to be attached to an article worn by a user.

2. The put out device as claimed in claim 1, wherein the casing includes a horizontal receptacle defined therein and a vertical hole defined in an upper side thereof and communicated with the horizontal receptacle, and the upper lid further includes a latch with a recess formed on an underside thereof, the latch being removably received in the vertical hole upon pivotal movement of the upper lid relative to the casing, and further comprising at least one torsional spring having a first end attached to the underside of the upper lid and a second end attached to the casing for biasing the upper lid to an open position, and further comprising a ball mounted in the horizontal receptacle and a spring mounted in the horizontal receptacle for biasing the ball to engage with the recess of the latch to retain the upper lid in a closed position, and wherein the upper lid further includes a recessed section for manual operation to pivot the upper lid relative to the casing, thereby removing the latch out of the vertical hole to disengage the ball from the recess of the latch to allow opening of the upper lid under the action of said at least one torsional spring.

3. The put out device as claimed in claim 2, wherein the recess of the latch has a diameter smaller than that of the ball.

4. The put out device as claimed in claim 1, wherein the casing includes two half casings, each said half casing including a separation wall to thereby define said ash compartment and said butt compartment when the half casings are assembled together.

5. The put out device as claimed in claim 4, wherein the first half casing includes a plurality of pegs provided along a periphery thereof, and the second half casing includes a plurality of holed stubs provided along a periphery thereof for releasably engaging with the pegs.

6. The put out device as claimed in claim 5, wherein each of the first half casing and the second half casing includes a ledge extended inwardly from a lower end thereof, and the bottom plate includes two lateral wings that slidably abut against the ledges, respectively.

7. The put out device as claimed in claim 6, wherein each said ledge includes at least one depression on an underside thereof, and the bottom plate includes a corresponding number of knurls for releasably engaging with said at least one depression.

8. The put out device as claimed in claim 1, wherein the casing includes two vertically spaced ribs formed on an inner periphery that defines the ash compartment to thereby define a receiving groove therebetween for securely receiving the meshy plate.

* * * * *